US005556106A

United States Patent [19]

Jurcisin

[11] Patent Number: 5,556,106

[45] Date of Patent: Sep. 17, 1996

[54] SOCCER TRAINING DEVICE AND METHOD OF TRAINING

[76] Inventor: Gregory D. Jurcisin, 114 Cleveland Ave., Milford, Ohio 45150

[21] Appl. No.: 490,226

[22] Filed: Jun. 14, 1995

[51] Int. Cl.[6] ..... A63B 69/00

[52] U.S. Cl. ..... 273/411; 273/395; 273/397

[58] Field of Search ..... 273/394, 395, 273/396, 397, 411

[56] References Cited

U.S. PATENT DOCUMENTS

| | | | |
|---|---|---|---|
| 1,371,867 | 3/1921 | Dean | 273/397 |
| 1,869,642 | 8/1932 | Woolman | 273/176 R |
| 2,011,146 | 8/1935 | Evans | 273/176 R |
| 2,059,365 | 11/1936 | King | 273/395 X |
| 2,234,856 | 3/1941 | Stanzel | 273/395 X |
| 3,326,556 | 6/1967 | Andersen | 273/395 X |
| 3,649,025 | 3/1972 | Garland | 273/395 X |
| 3,652,089 | 3/1972 | O'Connor | 273/395 |
| 3,776,550 | 12/1973 | McNabb | 273/395 X |
| 3,797,827 | 3/1974 | Child | 273/35 R |
| 3,802,705 | 4/1974 | Burns et al. | 273/395 X |
| 4,083,561 | 4/1978 | Daffer, Jr. | 273/57.2 |
| 4,286,786 | 9/1981 | Papadopoulos | 273/396 |
| 4,615,528 | 10/1986 | York | 273/396 |
| 4,667,957 | 5/1987 | Joseph | 273/397 X |
| 4,678,189 | 4/1987 | Koss | 273/395 X |
| 4,699,386 | 10/1987 | Carzino | 273/397 X |
| 4,934,697 | 6/1990 | Shiau | 273/35 B |
| 4,948,147 | 8/1990 | Pallanca | 273/396 X |
| 5,042,820 | 8/1991 | Ford | 273/395 |
| 5,257,780 | 11/1993 | Cook et al. | 273/397 X |

FOREIGN PATENT DOCUMENTS

| | | | |
|---|---|---|---|
| 667753 | 10/1929 | France | 273/411 |

*Primary Examiner*—William H. Grieb

*Attorney, Agent, or Firm*—Wood, Herron & Evans, P.L.L.

[57] ABSTRACT

A soccer training device that permits soccer kicking practice from one or more kicking locations and includes a generally vertical screen that is adapted to receive and absorb the kinetic energy of the soccer balls kicked into the screen. A trough is located immediately below the screen and collects the soccer balls dropping therefrom. The trough extends the length of and is generally parallel to the screen and is sloped toward a trough discharge. A soccer ball conveyor receives the soccer balls from the trough discharge and conveys the soccer balls to the kicking location of the kicking area. The training device reliably and consistently returns the soccer balls to the kicker such that, a high speed, highly repetitive soccer kicking exercise can be practiced.

30 Claims, 5 Drawing Sheets

SOCCER TRAINING DEVICE AND METHOD OF TRAINING

FIELD OF THE INVENTION

The invention relates generally to a soccer training device and more particularly, to a soccer training device that automatically returns the soccer ball to the kicker; in addition, the automatic ball return is able to serve two soccer ball kicking practice areas.

BACKGROUND OF THE INVENTION

Soccer practice or training devices are known which simulate soccer goals or other kicking targets and provide for a return of the kicked soccer ball to a kicking location. For example, in U.S. Pat. Nos. 4,615,528; 4,286,786; and 4,083,561, a ramp surface in front of a simulated goal is sloped toward the kicker and causes the soccer ball to roll back toward the kicker under the force of gravity. A disadvantage of those devices is that the return force on the ball is not sufficient to return the ball along a predictable or repeatable path over a grassy or uneven surface. Further, the return force is not sufficient to return the soccer ball a significant distance over an uneven turf or a manmade smooth surface.

To overcome the above disadvantage, U.S. Pat. No. 5,042,820 discloses a soccer ball return device which uses a sloped ramp to collect kicked soccer balls at a lower end of the ramp at one end of the target goal. The collected balls are then fed to a discharge location after which they are struck by a motor driven crank arm that applies a sufficient force to propel the soccer ball a significant distance away from the target goal. While that device is an improvement over the prior passive ball return ramps, the powered ball return has certain disadvantages of its own. For example, on grassy or other uneven surfaces, the trajectory of the ball from the point of impact over the uneven surface is unpredictable both with regard to distance and direction.

Other soccer practice machines, such as that disclosed in U.S. Pat. No. 4,699,386, are specifically designed as self-contained units that return the ball over a man-made smooth surface to a fixed location with respect to a target. While such a device provides a highly reliable and predictable return of the soccer balls, it has the disadvantage of lacking flexibility. For example, the device only provides a kicking practice for one leg and foot. In addition, the distance to goal and kicking surface cannot be varied.

None of the devices disclosed in the prior art provide a single training device that provides a reliable, predictable, high speed, highly repetitive kicking exercise with both, the left and the right, legs and feet.

SUMMARY OF THE INVENTION

An object of the present invention is to provide a soccer training device and associated method that collects kicked soccer balls from in front of a target and reliably returns the kicked soccer balls to one or more kicking locations whether kicking from smooth or uneven surfaces.

Another object of the invention is to provide a high speed, repetitive soccer ball kicking practice with both, the left and the right, legs and feet.

A further object of the invention is to allow the user can select how the returning soccer ball is to be presented at the kicking location, for example, in either a rolling or a bouncing motion.

Yet another object of the present invention is to provide a soccer training device that presents an indicator to the user when a kicked soccer ball hits a target.

To overcome the disadvantages of known devices with ball returns, the present invention provides a soccer training device having first and second screens located first and second distances from first and second kicking locations. The target screens receive and absorb kinetic energy of soccer balls kicked from the kicking locations. First and second troughs extend adjacent a length of and in a direction parallel to the respective first and second target screens, and the troughs slope toward a trough discharge. A conveyor located between the first and second target screens conveys the soccer balls from one end adjacent the trough discharge to a second end. The second end has first and second discharge paths for the soccer balls to the first and second kicking locations. Therefore, this aspect of the invention has the advantage of returning soccer balls to the two different kicking locations. Each of the different locations is oriented with respect to the conveyor to provide a soccer kicking practice with a different leg and foot. Therefore, training device facilitates a high speed, highly repetitive kicking practice with both, the right and the left, legs and feet.

In accordance with a further embodiment of the invention, the second end of the conveyor is selectively adjustable between a first, lower position immediately adjacent a kicking area surface and a second, higher position above the kicking area surface. The first position discharges returning soccer balls onto the kicking area surface with a rolling motion. In contrast, the second, higher position discharges the returning soccer balls onto the kicking area surface with a bouncing motion. This aspect of the invention has the advantage of providing a more varied soccer kicking practice in that the user can choose whether to practice kicking either a rolling soccer ball, or, a bouncing soccer ball.

In accordance with a still further embodiment of the invention, the trough has a generally vertical rear edge generally aligned with the target screen. A trough opening is located generally below and forward to the target screen so that soccer balls drop from the target screen directly into the trough opening. A soccer ball conveyor receives soccer balls from the trough discharge and conveys the soccer balls to the kicking location on the kicking area. This embodiment has the advantage of efficiently collecting kicked soccer balls in an area immediately in front of the target screen. The collected soccer balls are then conveyed to the kicking location, and the presentation of the soccer balls to the user has the advantage of being reliable and predictable and not subject to the irregularities of the surface of the soccer ball kicking area.

In accordance with another embodiment of the invention, the soccer ball conveyor includes a static conveyor providing an inclined path that slopes downward from the target screen toward the kicking area. In addition, an elevating conveyor lifts the collected soccer balls from the trough discharge to a higher end of the static conveyor. The elevating conveyor also includes a plurality of soccer ball carriers, each of which include a first arcuate member sized to receive a soccer ball and having an opening facing toward a direction of conveyor motion. The first arcuate member is fixed to the elevating conveyor and extends outward therefrom. The ball carrier includes a second arcuate member is sized to receive a soccer ball and has an opening facing toward the elevating conveyor and is connected at its midpoint to an outwardly extending end of the first arcuate member. The construction of the ball carrier provides a simple and inexpensive mechanism for holding soccer balls which may vary in size. Therefore, the soccer training device has the advantage of accommodating players of all ages who, depending on their age and skill level, may use different size soccer balls. Further, the elementary structure of the ball carrier facilitates the discharge of the different size soccer balls from the carrier to the static conveyor.

In accordance with yet other embodiments of the invention, the soccer training device provides a method of kicking soccer balls from two different locations, collecting the soccer balls and returning them to the two different kicking locations. Other methods are provided for discharging the soccer balls with different motions. These and other objects and advantages of the present invention will become more readily apparent during the following detailed description together with the drawings herein,

DETAILED DESCRIPTION OF THE INVENTION

Figure 1:
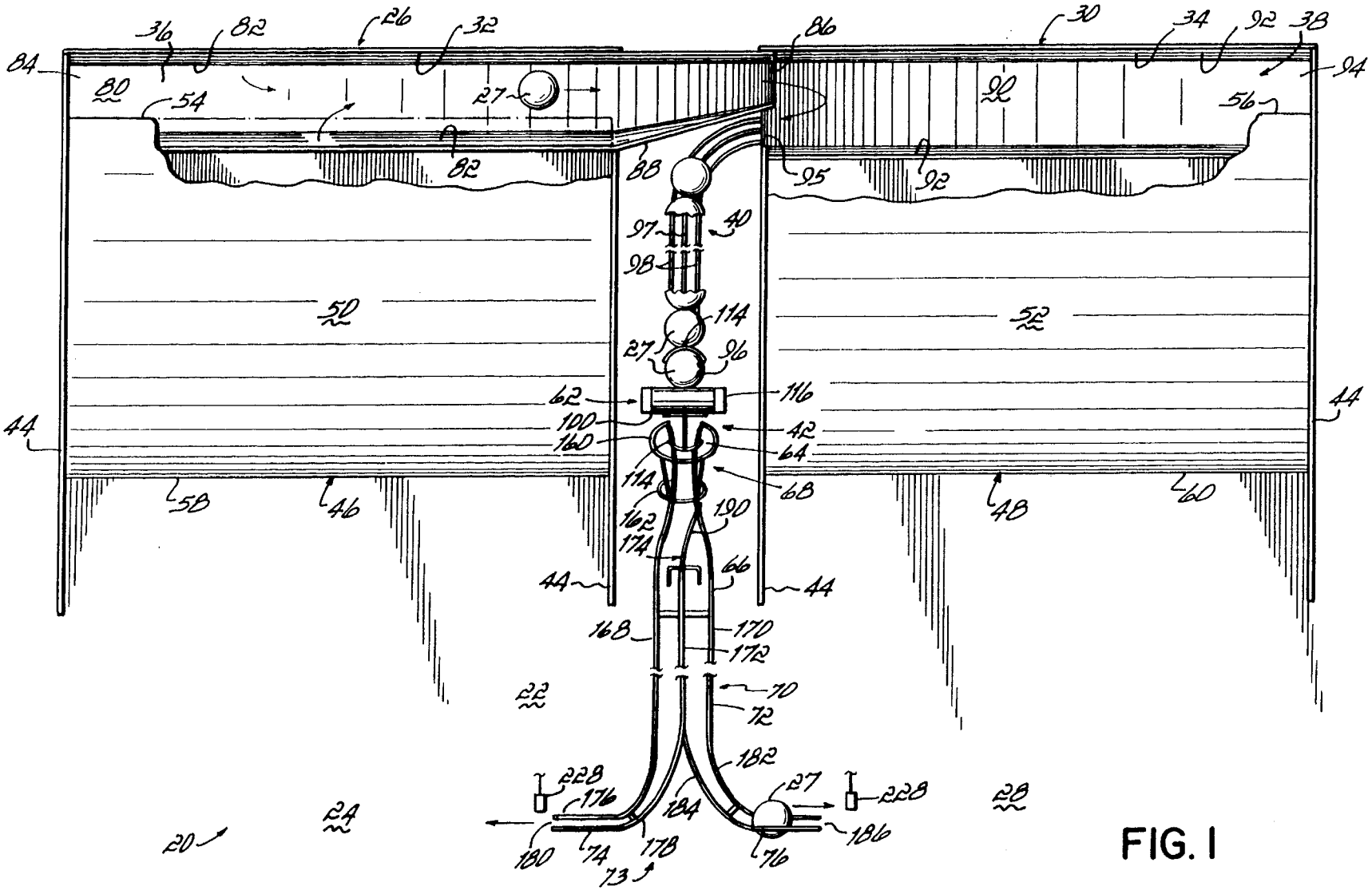
FIG. 1 is a top plan view of a soccer training device having two kicking locations in accordance with the principles of the present invention.

Referring to FIG. 1, a soccer training device 20 is located on a kicking area surface 22 which may be a relatively smooth surface, for example, a concrete or wooden floor or artificial turf located inside a building or, alternatively, may be a surface of concrete, asphalt, or grass located out of doors. A first kicking location 24 is displaced a first distance from a target screen 26 and a second kicking location 28 is displaced a second distance from a second target screen 30. Soccer balls 27 are kicked from the kicking locations 24, 28 toward the generally vertical respective target screens 26, 30. The target screens 26, 30 are made from canvas, plastic sheet, netting, or any other material that absorbs the kinetic energy of the kicked soccer ball 27 in a direction that is generally perpendicular to the front surfaces 32, 34 of the respective target screens 26, 30. After the target screens 26, 30 absorb the kinetic energy in the generally horizontal direction, the soccer balls change direction and are pulled down the front surfaces 32, 34 by the force of gravity. The vertically dropping soccer balls 27 are captured within first and second troughs 36, 38, respectively, which slope toward a trough discharge 40. The troughs 36, 38 extend along the lengths of the respective target screens 26, 30; and therefore, the troughs 36, 38 extend in directions that are generally parallel to the planes of the generally vertical front surfaces 32, 34. The soccer balls 27 are removed from the trough discharge 40 by a soccer ball return conveyor 42 which conveys the soccer ball 27 back to the kicking locations 24, 28 on the kicking area surface 22.

Preferably, the kicking locations 24, 28 are bounded by generally vertical side screens 44 that extend in a generally perpendicular direction with respect to the front surfaces 32, 34 of the target screens 26, 30. The side screens 44 are preferably made of a lightweight material that will endure being struck by a kicked soccer ball. The target screens 26, 30 and side screens 44 may be hung and held in the generally vertical direction by known mechanisms. For example, if the kicking area is in a building, the screens may be suspended from a ceiling or overhead structural elements or tracks so that they are either generally fixed or movable. If the kicking area surface 22 is out of doors, the target screens 26, 30 and side screens 44 may be suspended from crossbars extending between vertical posts. The vertical posts may either be set in concrete within the ground or stabilized by bases that rest on the kicking surface 22. Preferably, the vertical edges of the target screens 26, 30 and side screens 44 should be connected at intermediate points to prevent kicked soccer balls from escaping from the bounded kicking areas defined by the target screens 26, 30 and side screens 44.

The troughs 36, 38 of the training device 20 are positioned above the kicking area surface 22. Therefore, in order to collect kicked soccer balls 27 which simply roll over the kicking area surface 22. Ramps 46, 48 are located in front of the troughs 36, 38, respectively. The ramps 46, 48 have respective inclined surfaces 50, 52 that extend from forward edges 58, 60, preferably resting on the kicking surface 22, to rear edges 54, 56. The rear edges 54, 56 are elevated above the kicking area surface 22 to a position which is immediately adjacent and contiguous with forward edges of the troughs 36, 38, respectively. Consequently, soccer balls which are not kicked with an elevation but instead roll across the kicking area surface 22, will roll up the inclined surfaces 50, 52 and collect in the respective troughs 36, 38.

The ball return conveyor 42 further includes an elevating conveyor 62 which picks up and removes soccer balls 27 from the trough discharge 40. The elevating conveyor 62 extends and lifts the soccer balls 27 in a generally vertical direction and deposits the soccer balls onto the upper end of a static conveyor 66. The static conveyor 66 has an entry section 68 that receives the soccer balls 27 from the elevating conveyor 62. The entry section 68 has a first relatively steep drop and is effective to direct the soccer balls 27 onto the primary conveying section 70. The primary conveying section 70 provides a downward sloping path for the soccer balls that extends from the entry section 68 to a lower end 72 which is connected to a terminal discharge conveyor 73 located adjacent the kicking locations 24, 28. The terminal discharge conveyor 73 includes first and second discharge conveyor sections 74, 76 which provide respective first and second discharge paths that are directed toward the respective first and second kicking locations 24, 28.

The trough 36 is preferably designed as a chute which has a generally flat and smooth bottom surface 80 that is bounded on its longitudinal edges by sidewalls 82 which slope downward, for example, at approximately a 45° angle toward the bottom surface 80. The trough 36 is oriented such that it has a longitudinal slope which drops from a higher end 84 to a lower discharge end 86. The trough 36 is further oriented such that the bottom surface 80 slopes downward from the forward edge next to the higher edge 54 of the ramp 50 toward a rearward edge adjacent the front surface 32 of the target screen 26. The trough 36 has a sidewall 88 which narrows the trough 36 as it approaches the discharge end 86 so that soccer balls are discharged one at a time.

The trough 38 is similar in design to trough 36 and has a flat smooth bottom surface 90 that is bounded on its longitudinal edges by sidewalls 92 which are inclined outward with respect to the bottom surface 90 in a manner similar to side walls 82 of trough 36. The trough 38 slopes downward from a rear edge next to the front surface 34 of the target screen 30 to its forward edge next to the elevated edge 56 of the ramp surface 52. In addition, the trough 38 slopes longitudinally downward from a higher end 94 to its discharge end 95. Soccer balls 27 entering the trough 38 exit through the discharge end 95 into the discharge conveyor 40.

The discharge conveyor 40 slopes downward from the discharge end 95 to the pickup station 96 at the other end of the trough discharge conveyor 40. The trough discharge conveyor 40 is preferably constructed with a tubular center rail 97 and spaced tubular side rails 98. The conveyor 40 should present the least friction so that returning soccer balls roll through the trough discharge conveyor 40 at a high speed. Therefore, the conveyor 40 is designed such that the ball rides continuously on the lower center rail 97 and is guided by the higher side rails 98. The guide rails 98 preferably have a spacing such that the soccer ball only contacts one of the side rails 98 at any time. Preferably, the other end of the trough discharge conveyor 40 adjacent the pick up station 96 has a lesser slope so that at least two soccer balls adjacent the pick up station 96 are in a generally horizontal plane (FIG. 3).

Figure 3:
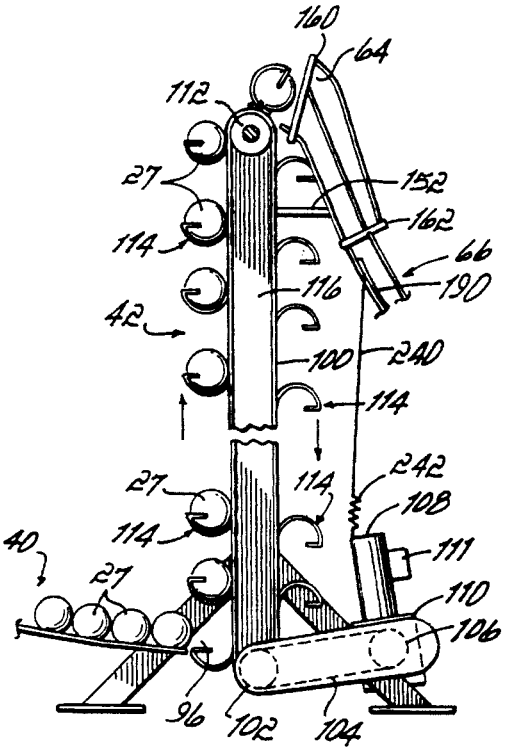
FIG. 3 is a partial cross-sectional view taken along line 3—3 of FIG. 2.

Referring to FIG. 3, the elevating conveyor 62 includes a conveying element, for example, a continuous, looped conveyor belt 100, that moves in generally vertical directions and is powered at one end by a drive roller 102. Drive roller 102 is powered by a drive belt or chain 104 that, in turn, is driven by drive shaft 106. The drive shaft 106 is powered by a motor 108 through a right angle drive 110 connected between the output shaft of the motor and the drive shaft 106. The motor 108 preferably has a speed controller 111 which permits the speed of the conveyor belt 100 to be adjusted to suit the needs of the user. The conveyor belt 100 extends around the drive roller 102 at the lower end of the elevating conveyor 62 and an idler roller 112 at its upper end. Ball carriers 114 are intermittently, and preferably, equally, spaced along the conveyor belt 100. The conveyor 62 includes side frame members 116 to which the drive roller 102 and idler roller 112 are rotatably mounted. The side frames 116 rest on the kicking area surface 22 and maintain the conveying element 100 in a stable, generally vertical, orientation.

Figure 4:
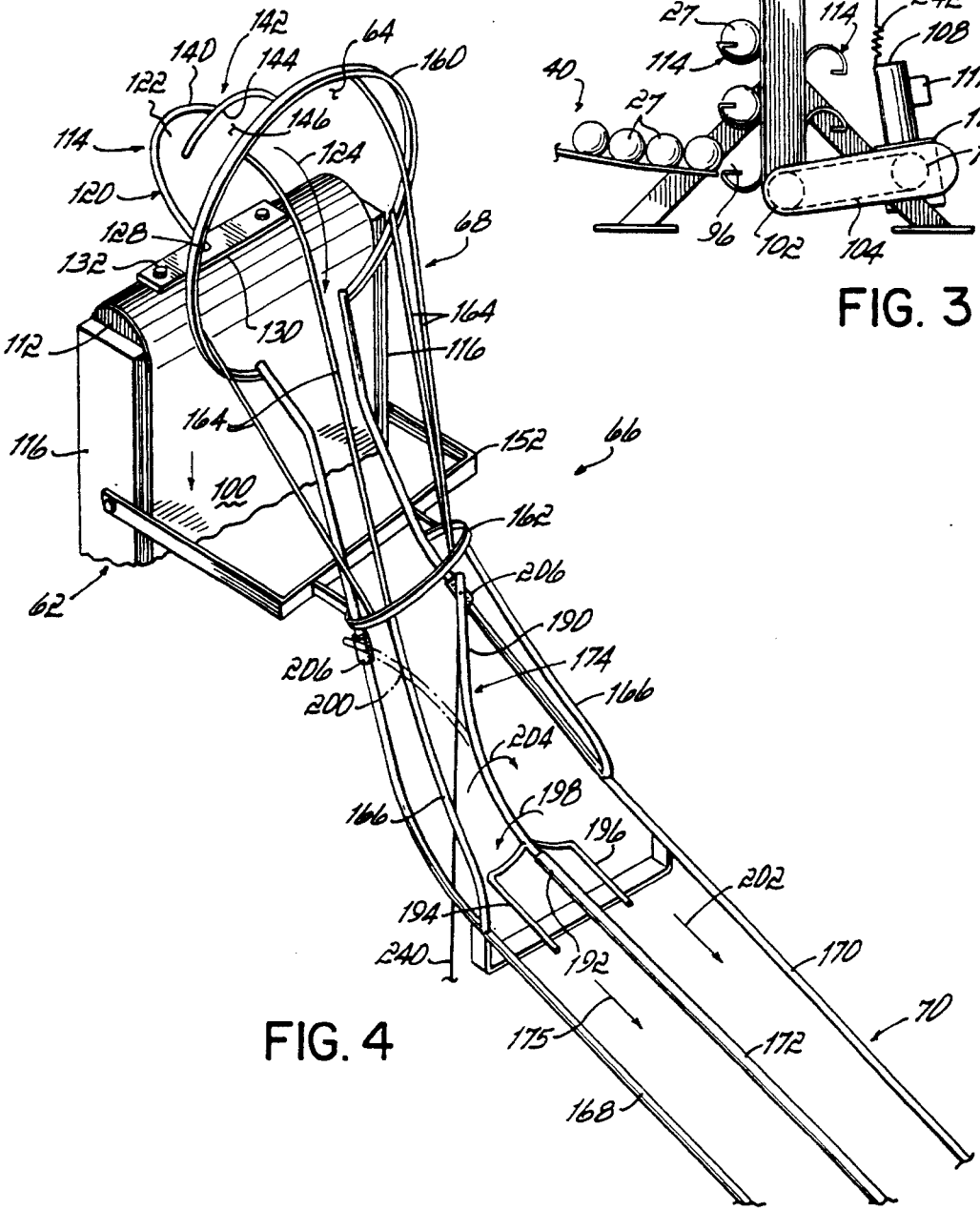
FIG. 4 is a perspective view of the interconnection between the elevating ball conveyor and the static conveyor which includes a toggle mechanism in accordance with the principles of the present invention.

Referring to FIGS. 4, the ball carriers 114 lift the soccer balls which have been collected in the discharge trough 40 from the pickup station 96 to the top of the elevating conveyor 62 and discharge the soccer balls into an upper end 64 of the static conveyor 66. Each of the soccer ball carriers 114 is made from a first, arcuate, and preferably, semicircular rod-like element 120 that has an opening 122 facing in the direction of conveyor motion 124. The first element 120 is connected at one end 128 to mounting plate 130 that in turn is mounted by fasteners 132 to the conveyor belt 100. The first element 120 has a distal end 140 that extends outwardly in a generally perpendicular direction from the conveyor belt 100; and the distal end 140 is connected at approximately the midpoint 144 of a second, arcuate, generally semicircular, rod-like element 142. The second element 142 is oriented in a plane that is generally perpendicular to both the surface of the conveyor belt 100 and the longitudinal centerline of the elevating conveyor 62. The second element 142 has an opening 146 that generally faces the surface of the conveyor belt 100. The first and second arcuate members 120, 142 are shaped to receive, cradle, hold, and lift a soccer ball 27 as the conveying element 100 moves in the generally vertically upward direction, As the ball carrier 114 passes around and over the idler roller 112, the soccer ball 27 is discharged, that is, falls from the ball carrier 114 into the upper end 64 of the static conveyor 66. The static conveyor 66 includes a bracket 152 which is connected between the entry section 68 and an upper end of the side frame members 116 of the elevating conveyor 62. The upper end 64 of the entry section 68 of the static conveyor 66 includes arcuate frame elements 160, 162 which have interconnecting metal rods, or straps, 164 extending therebetween. The conveyor elements 160, 162, 164 are effective to capture and stabilize the soccer balls as they drop from the ball carriers 114 onto the static conveyor 66. Other stabilizing elements 166 extend between the arcuate element 162 and first and second side rails, respectively, 168, 170 of the primary section 70 of the static conveyor 66. The primary section 70 further includes a center rail 172 which is coupled to a diverter 174 which will subsequently be described. Given the position of the diverter 174 illustrated in FIG. 4, the soccer balls 27 will pass down the static conveyor 66 along a path 175 extending between the rails 168, 172.

Referring to FIG. 4, the diverter 174 includes a pivoting guide rail 190 which is rotatably coupled into the end 192 of the center rail 172. The diverter 174 further includes actuating levers 194 and 196. When the guide rail 190 is in the position shown, and the soccer ball rolls between the guide rail 190 and first side rail 168, the soccer ball will roll over the first actuating lever 194. The weight of the soccer ball pushes the actuating lever 194 downwards and guide rail 190 pivots in a generally counter clockwise direction 198 which rotates the guide rail 190 to the position shown in phantom at 200. In addition, the pivoting motion of the guide rail 190 effectively moves the actuating lever 196 to a more elevated position with respect to the rails 170, 172. The next soccer ball to enter the upper end 64 of the static conveyor 66 will roll between the pivoting guide rail 190 shown in phantom at 200 and the second side rail 170, pass over the second actuating lever 196 and proceed to roll down a second path 202 between the second side rail 170 and center guide rail 172. In a manner opposite to that just described, when the ball rolls over the second actuating lever 196, the second actuating lever is pushed generally downward and pivots the guide rail 190 in a clockwise direction 204, thereby rotating the guide rail 190 is pivoted to its original position as shown in solid lines in FIG. 4. Therefore, the diverter 174 is effective to divert and direct alternate soccer balls entering the static conveyor 66 along a first path 175 between guide rails 168, 172 and a second path 202 between guide rails 170, 172. The diverter 174 includes pads 206 which absorb the kinetic energy of the pivoting guide rail 190 and prevent the guide rail 190 bouncing off of the rails 168, 170. To further maintain the guide rail 190 in its proper location, a wire or line 240 (FIG. 4) is attached to the end of the guide rail 190 and extends down to the motor 108 (FIG. 3) where it is connected to one end of a tension spring 242 the other end of which is connected to the housing of the motor 108. The tension from the spring 242 helps to hold the end of the guide rail 190 against the pads 206.

Figure 2:
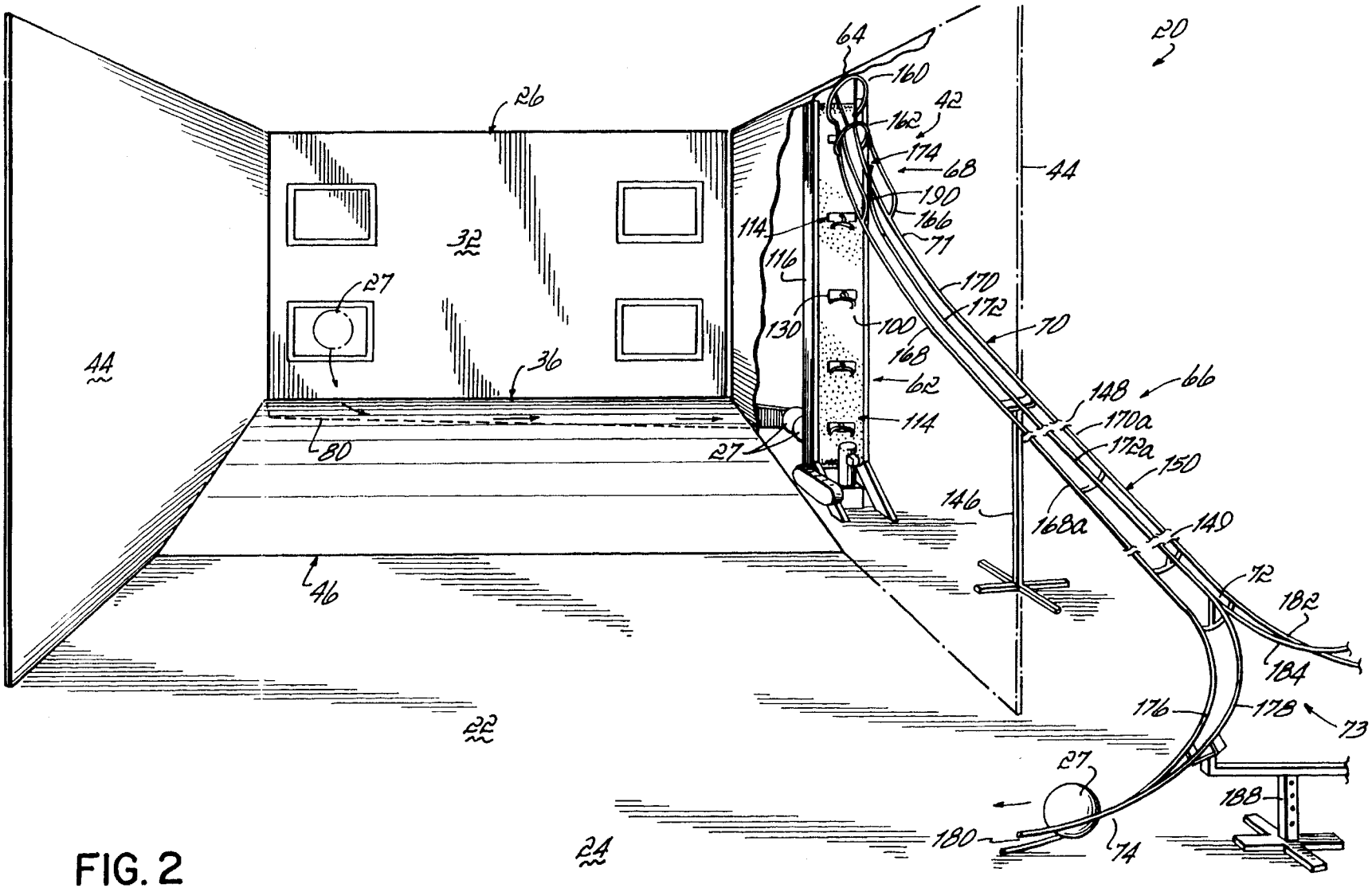
FIG. 2 is a front perspective view illustrating one of the soccer kicking locations.

Referring to FIG. 2, the primary conveyor section 70 extends between a higher end 71 connected to the inlet conveyor section 68 and a lower end 72 connected to the terminal discharge conveyor 73. The primary conveyor section 70 is supported at a desired elevation by one or more adjustable vertical support posts 146, which may be used to raise and lower the primary conveyor section 70 to desired heights. As indicated by the break lines at 148, 149, the primary conveyor section 70 is adjustable in length. For example, the conveyor section 70 may contain one or more separate track sections 150 which can be either inserted or removed from the conveyor section 70. The track section 150 is constructed of the same tubular material, however, the ends of the tubes 168*a*, 170*a*, 172*a* are sized to either slide within or over to overlap with adjoining rails. The track section 150 may be, for example, from 4 feet to 8 feet in length and be designed to slide in or over and thereby overlap adjoining rails up to, for example, 4 feet, thereby allowing the conveyor section 70 to be selectively lengthened to change the distance of the kicking locations 24, 28 from the respective target screens 26, 30.

Throughout most of the length of the conveyor section 70, the side rails 168, 170 are located generally in a plane that is slightly below the center rail 172. However, as the returning soccer balls 27 reach the lower end 72 of the primary conveyor section 70, they are traveling at a relatively high speed and must traverse a change of direction of approximately 90° as they move through the terminal discharge conveyor 73. So that the returning soccer balls are reliably discharged at repetitive and predictable speeds and with repetitive and predictable motions, their travel through the angled terminal discharge conveyor 73 must be smooth. To better control the travel of the soccer ball through the lower end of the conveyor section 70 and the terminal discharge conveyor 73, the center rail 172 is gradually elevated above the side rails 168, 170 to substantially incline or bank the path of the returning soccer balls as they move through the terminal discharge conveyor 73.

The first and second discharge conveyor sections 74, 76 of the discharge conveyor 73 are similar in construction. Referring to discharge conveyor section 74, rails 176, 178 extend through a discharge path that bends approximately ninety degrees from the lower end 72 of the primary conveyor 70 to discharge end 180 of the discharge conveyor section 74. Similarly, rails 182, 184 extend through a discharge path that bends approximately ninety degrees from the lower end 72 of the primary conveyor 70 to discharge end 186 of the discharge conveyor section 76. The terminal discharge conveyor 73 is supported by an adjustable vertical support post 188. The heights of the vertical support posts 146, 188 may be adjusted to raise and lower the discharge ends 180, 186 of the terminal discharge conveyor 73 so that the returning soccer balls 27 are presented to the user with different motions, for example, a rolling motion or a bouncing motion.

Figure 5:
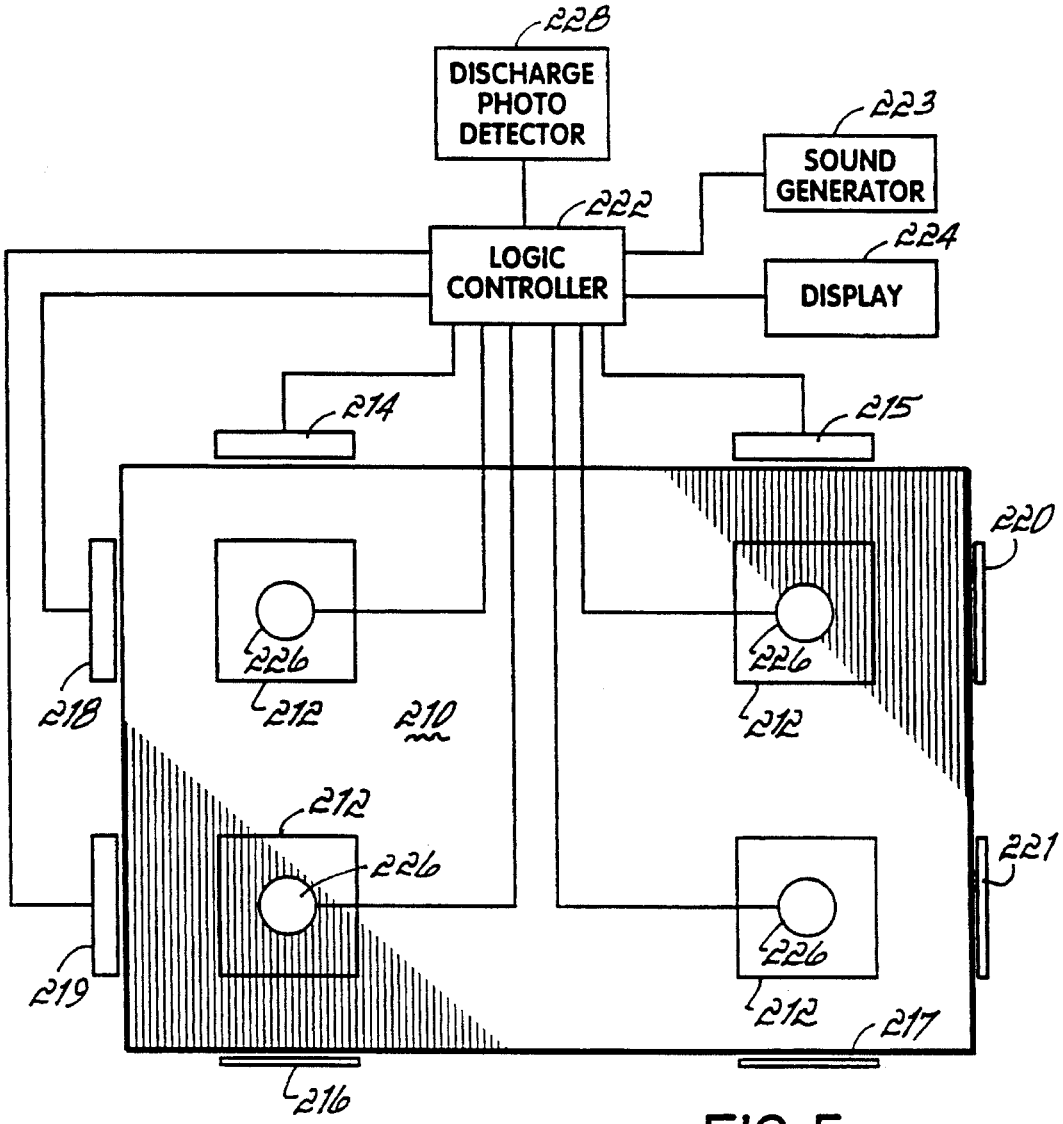
FIG. 5 is a schematic diagram of an alternative embodiment of the target screen including devices for detecting when a kicked soccer ball hits a target.

FIG. 5 illustrates a further embodiment of the invention in which a target screen 210, substantially identical to the target screens 26, 30, has located thereon a plurality of target indicia 212. First sensors, for example, photo transmitters 214, 215 are located along one edge, for example, the top edge, of the target edge 210 and are aligned with opposing mirror elements 216, 217, respectively. The size and shape of the mirror elements 216, 217 determine the width of a light beam reflected back to the respective photo transmitters 214, 215. The width of the light beam is preferably the width of the target indicia 212 so that any soccer ball breaking the light beam is detected by the photo transmitters 214, 215. Second sensors, for example, photo transmitters 218, 219 are located along a lateral edge of the target screen 210, for example, the left edge as viewed in FIG. 5. Corresponding mirrors 220, 221 are located along the right lateral edge of the target screen 210 and reflect back to their respective photo transmitters 218, 219 a light beam having a width corresponding to the height of the target indicia 212. Therefore, any soccer ball striking one of the target indicia 212 is also detected by one of the photo sensors 218, 219. The described sensors are infrared photo sensors, but the sensors may be ultrasonic or any other type that is able to detect a soccer ball striking one of the target indicia 212 that is aligned with the sensor. The sensors 214, 215, 218, 219 provide output signals to a logic controller 222 which is connected to a display 224.

In one mode of operation, the logic controller 222 responds to the output signals from the sensors in order to determine which one of the target indicia 212 has been struck by the soccer ball. Further, illuminated displays may be associated with the different target indicia on the target screen, and each of the displays illuminated every time its associated target indicia 212 is struck by a kicked soccer ball. Further, the display may include a count of the number of soccer balls striking one or all of the targets. Alternatively, or in addition to providing a visual display, the logic controller 222 may also be connected to a sound generator 223, which provides an audible signal each time one of the target indicia 212 is struck by a soccer ball. Alternatively, each of the indicia 212 may be a transparent screen section behind which is mounted a light indicator 226, and each of light indicators 226 is connected to an output from the logic controller 222. Further, referring to FIG. 1, a discharge photo sensor 228 is mounted adjacent the exits 180, 186 of the respective discharge conveyors 74, 76. Each time a photo sensor 228 detects a ball being discharged from the conveyor, the logic controller provides an output signal to randomly illuminate one of the lights 226, thereby identifying a respective one of the target indicia 212 as the target to be aimed at by the soccer kicker.

In use, the soccer training device 20 described in association with FIGS. 1–5 provides a fast, highly repetitive, soccer kicking exercise. Preferably, soccer balls 27 exit from each side of the terminal discharge conveyor 73 approximately once every two seconds. The high speed of the kicking practice requires that the kicker only have time to plant one foot and kick with the other leg and foot. Further, the shorter time within which to kick the soccer ball requires that the kicker use a more abbreviated kicking stroke and develop the capability of aiming the soccer ball with less concern about how hard the soccer ball is kicked. In addition, when using the two kicking locations 24, 28, the user must practice kicking with both the left and right legs and feet.

Using both kicking location 24, 28 as returning soccer balls are discharged from the discharge conveyor sections 74, 76, sensors 228 detect the exiting soccer balls; and the controller 222 illuminates a target indicia 212 on the target screens 26, 30. Balls kicked from the kicking location 24 strike the target screen 26 and drop into the return trough 36. The inclination of the trough 36 causes the soccer balls to roll toward the discharge end 86 of the trough along its rear edge adjacent the target screen 26. The balls collected in the trough 36 are discharged from the discharge end 86 into the trough 38 where they mix with balls being kicked from the kicking location 28. Soccer balls exit the trough 38 through the discharge end 95 and enter the trough discharge conveyor section 40 which provides a slight incline for the balls down to the pickup station 96. Preferably, the trough discharge conveyor 40 has a length that permits eight to ten soccer balls to queue within the trough discharge conveyor 40. Further, the end of the trough discharge conveyor 40 that feeds the pickup station 96 has a lesser incline so that as a ball is picked up from the pickup station 96 by the elevating conveyor 62, it does not lift the ball immediately behind it. By providing a queue of eight to ten soccer balls in the trough discharge conveyor 40, soccer balls will constantly flow through the trough 38.

The elevating conveyor 62 lifts the returning soccer balls 27 and deposits them in the higher end of 64 of the inlet section 68 of the static conveyor 66. The speed of the motor 108 of the elevating conveyor is adjusted to deposit a soccer ball into the inlet section 68 once every second in order to achieve a discharge from each of the discharge conveyor sections 74, 76 of one ball every two seconds. The diverter in the inlet section 68 directs the returning soccer balls alternately to the two different paths 175, 202 to the respective discharge conveyor sections 74, 76, Therefore, soccer balls are presented to the users at the kicking locations 24, 28 from the discharge conveyor sections 74, 76 once every two seconds. The soccer ball exits 180, 186 of the respective discharge conveyor sections 74, 76 may be positioned to be close to or lie on the kicking surface 22, so that the returning soccer balls are presented to the users with a rolling motion. Alternatively, the soccer ball exits 180, 186 of the respective discharge conveyor sections 74, 76 may be elevated by adjustable support post 188 approximately eighteen inches to present returning soccer balls to the users with a bouncing motion. Further, track sections 150 may be inserted or removed to adjust the length of the static conveyor 66, thereby permitting the distance of the kicking locations 24, 28 from their respective target screens 26, 30 to be adjusted. Preferably, the kicking locations 24, 28 can be adjusted in the range of from approximately 25 feet to approximately 45 feet from their respective target screens 26, 30.

Figure 6:
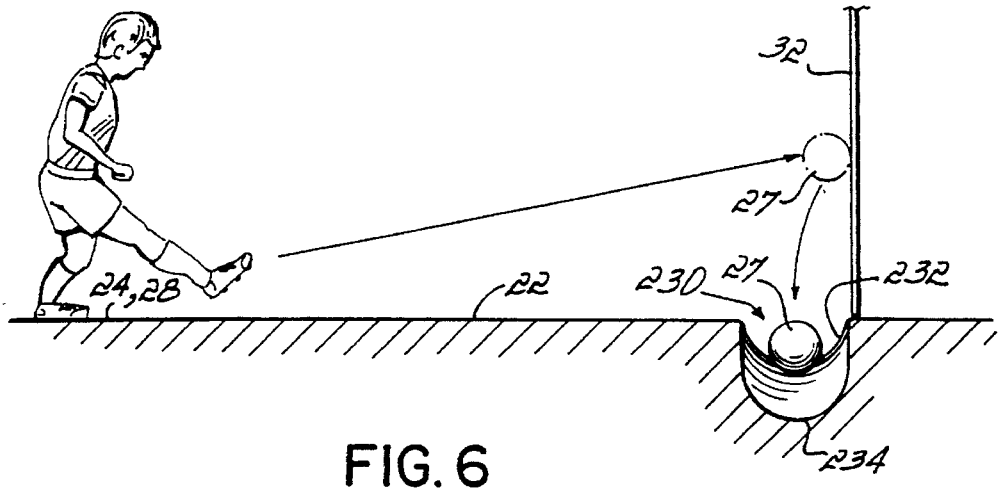
FIG. 6 is a side view of a alternative embodiment of the invention which illustrates that the ball collecting trough may be formed by a channel cut below the kicking area surface.

While the invention has been set forth by a description of the embodiments in considerable detail, it is not intended to restrict or in any way limit the claims to such detail. Additional advantages and modifications will readily appear to those who are skilled in the art. For example, the troughs 36, 38 are shown constructed above the kicking area surface 22. Alternately, as shown in FIG. 6, a trough 230 is located below the kicking area surface 22. The trough 230 has a shallow end 232 and slopes toward a deeper end 234. Therefore, the trough 230 has a inclined path for the returning soccer ball 27 to move under the force of gravity along the trough 230 to a trough discharge (not shown). With the trough design illustrated in FIG. 6, the ramps 46, 48 of FIG. 1 are not required. Consequently, a training device having troughs located below the kicking area surface will collect more of the kicked soccer balls because it will collect soccer balls that have a force sufficient to move them across the surface 22, but not sufficient to move them up the ramps 46, 48.

Figure 7:
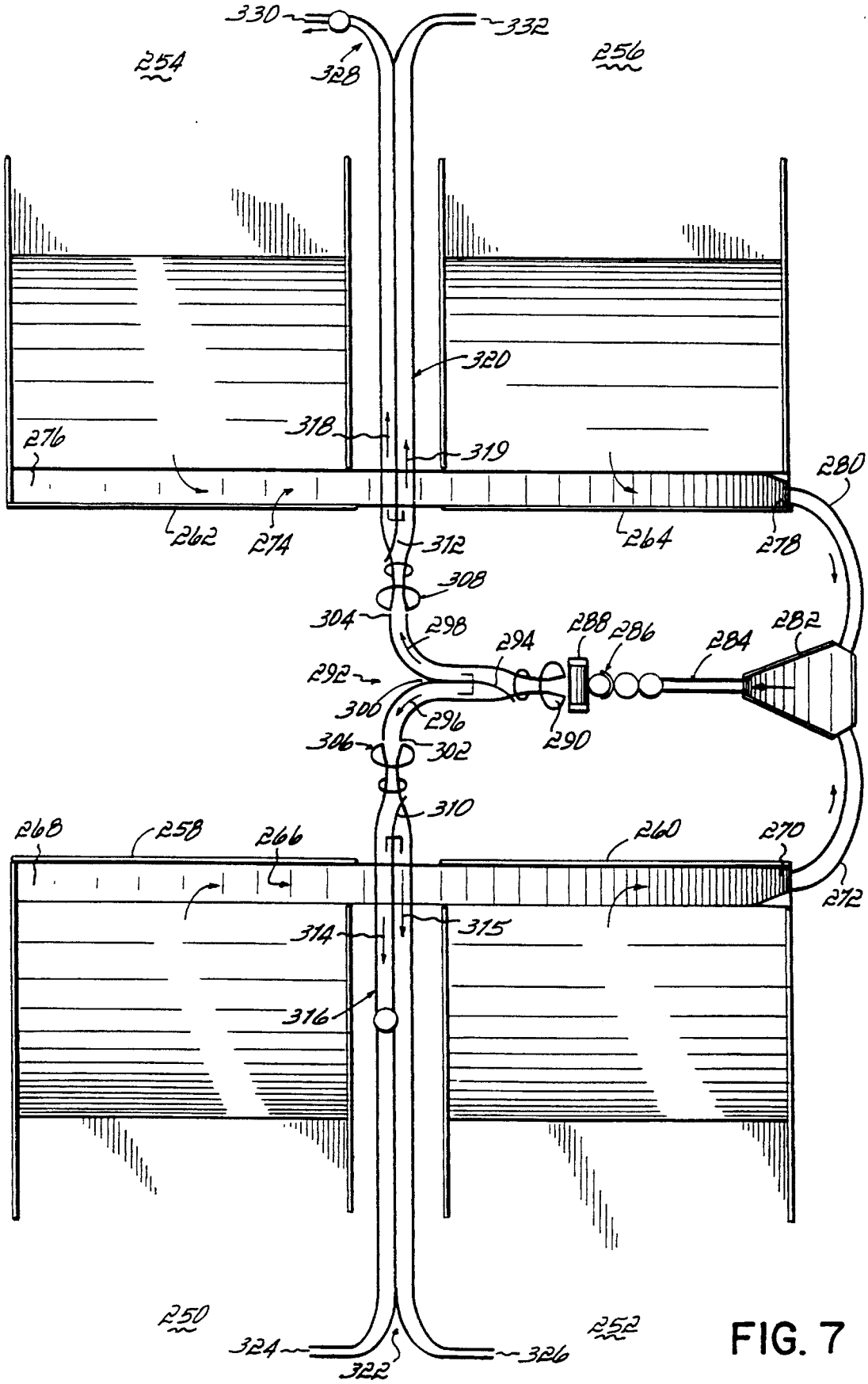
FIG. 7 is a top plan schematic illustration of a soccer training device having four kicking locations in accordance with the principles of the present invention.

FIG. 7 illustrates a further alternative embodiment of the invention in which a soccer training device utilizes four kicking locations 250, 252, 254, 256 which are in front of target screens 258, 260, 262, 264, respectively. Kicking locations 250, 252 and their respective screens 258, 260 are arranged as a side-by-side pair and are back-to-back with target screens 262, 264 and their respective kicking locations 254, 256, which are also arranged as a side-by-side pair. Trough 266 is located immediately below target screens 258, 260 and extends longitudinally therewith sloping from a higher end 268 to a lower end 270. Target screens 258, 260, 262, 264 are similar in construction and operation to screens 26, 30 of FIGS. 1 and 2; and troughs 266, 274 are similar in construction and operation to troughs 36, 38 of FIGS. 1 and 2.

After striking the target screens 258, 260, the kicked soccer balls fall into the trough 266 and roll out the lower end 270 into a first trough discharge conveyor 272. In a similar manner, trough 274 is located below and in front of target screens 262, 264 and slopes from a higher end 276 to a lower end 278. After hitting the target screens 262, 264, kicked soccer balls fall into the trough 274 and are discharged at the lower end 278 into a second trough discharge conveyor 280. The returning soccer balls pass through the trough discharge conveyors 272, 280 into a common collection area 282. The conveyors 266, 272, 274, 280 may be either static conveyors, belt conveyors, or combinations of both static and belt conveyors.

A feeder conveyor 284 extends from the collection area 282 along a path between the two pairs of side-by-side target screens to a pickup station 286 for an elevating conveyor 288. Again, the feeder conveyor 284 may be a static conveyor or a power conveyor, or, may be a static conveyor with a powered conveyor at the pick-up station of the elevator conveyor 288. The elevating conveyor 288 is similar in construction and operation to the elevating conveyor 62 shown in FIGS. 2 and 3. The elevating conveyor 288 lifts the returning soccer balls from the pick-up station 286 and discharges elevated soccer balls into an entry section 290 of a static conveyor 292. The entry section 290 is similar in construction and operation to the entry section 68 of FIG. 4 and leads into a first diverter 294 that is similar in construction and operation to the diverter 174 of FIG. 4. The diverter 294 alternately directs soccer balls along the two paths 296, 298 and into a first split conveyor section 300 of static conveyor 292 which is similar in construction and operation to the terminal discharge conveyor 73 illustrated in FIGS. 1 and 2.

Returning soccer balls exit the split conveyor 300 at outputs 302, 304 and enter second and third inlet sections 306, 308, respectively. The inlet sections 306, 308 are similar in construction and operation to the inlet conveyor section 68 illustrated in FIG. 4. The inlet sections 306, 308 lead to second and third diverters 310, 312, respectively, which are similar in construction and operation to the diverter 174 illustrated in FIG. 4. Upon leaving the diverter 310, alternate soccer balls are directed along return paths 314 and 315 at the higher end of a first linear static conveyor section 316 of static conveyor 292. Similarly, soccer balls leaving the diverter 312 are alternately directed along paths 318 and 319 at the higher end of a second linear static conveyor section 320 of static conveyor 292. Linear static conveyor sections 316, 320 are similar in construction and operation to the static conveyor section 70 of FIGS. 1 and 2. The lower end of static conveyor section 316 is connected to a terminal discharge conveyor 322 with outputs at 324, 326 that direct the returning soccer balls to the kicking locations 250, 252, respectively. Similarly, the lower end of static conveyor section 320 is connected to a terminal discharge conveyor 328 with outputs 330, 332 that direct the returning soccer balls to the kicking locations 254, 256, respectively. The terminal discharge conveyors 322, 328 are similar in construction and operation to the terminal discharge conveyor 73 illustrated in FIGS. 1 and 2. As will be appreciated, the troughs 266, 274, elevating conveyor 288 and static conveyor 292 can be replaced by powered conveyors, for example, belt conveyors or otherwise.

The target screens 26, 30 are described and illustrated as two different screens that are generally in a common plane. However, the target screens 26, 30 may be constructed from a single sheet of material that extends the full width of the first and second kicking locations. Alternatively, the first and second kicking locations may be angled with respect to each other. While the preferred soccer screens 26, 30 each have a target area that is approximately the same size as the area of a soccer goal, any size target screen may be used.

The preferred speed of soccer ball return is approximately one ball every two seconds, and therefore, soccer balls must be deposited into the static conveyor 66 once per second. The speed with which soccer balls are deposited onto the static conveyor 66 is dependent on the slopes of the troughs 36, 38 and the discharge conveyor 40 as well as the spacing between the carriers 114 on the conveyor 62. Increasing the slopes of the troughs 36, 38 also increases the height of the ramps 46, 48 which is less desirable. Therefore, a desired mix of all the above parameters must be determined depending on the size of the target screens 26, 30 and the distance of the kicking locations 24, 28 from the respective target screens. A slope of 1.5 inches per foot has been found to be generally satisfactory.

In order to better control the path of the returning soccer balls, additional side rails may be used with the trough discharge conveyor 40 or the terminal discharge conveyor 73. Ball control is also improved by sloping the longitudinal axis of the elevating conveyor 62 slightly forward so the soccer balls rest against the conveyor belt 100 as they are being lifted. The speed can be further improved by providing a small generally horizontal conveyor at the discharge station 96 that runs at the speed of conveyor 62 and carries approximately two soccer balls toward the discharge station 96 Further, for less skilled players, the speed of the motor 108 of the elevating conveyor may be adjusted to accommodate the skill levels of the practicing kicker. In addition, the speed controller 111 for the elevating conveyor 62 may be moved to the kicking locations 24, 28 for convenience. As will be appreciated, the invention as described can be used with only one of the kicking locations 24, 28 by replacing the diverter rail 190 with a different one that has none or only one actuating lever; and therefore, the different diverter rail can be positioned to return soccer balls to only a single kicking location. Alternatively, the actuating levers 194, 196 can be made to be removable. The diverter rail 190 can also have a spring pulling it in a downward direction so that it is more securely positioned.

The troughs 36, 38, 230, 266, 274 and discharge 40 are described as static conveyors, however, belt type conveyors or other powered conveyors may be substituted for the troughs. The static conveyor 66 is preferably constructed of metal conduit. Alternately, the static conveyor may be made from other tubing or bar stock, as desired. The diverter 174 is preferably shown located closer to the upper end 64 of the static conveyor 66. As will be appreciated, the diverter is preferably at that location so that the energy from the returning soccer ball that is used to operate the diverter is taken away from the ball early in the return path. However, the diverter 174 may be moved toward the lower end 72 of the conveyor section 70.

The terminal discharge conveyor 73 is preferably rigidly connected to the end of the static conveyor 66 and moved to different heights by means of the adjustable vertical post 188. Alternatively, the upper ends of the rails 176, 178 of the discharge conveyor section 74 may be pivotally connected to the lower ends of the respective rails 168, 172. Similarly, the upper ends of the rails 182, 184 of the discharge conveyor section 76 may be pivotally connected to the lower ends of the respective rails 170, 172. The pivotal connections can be a friction fit such that each of the discharge conveyor section 73 can be manually adjusted to the desired height. Alternatively, the discharge ends 180, 186 of the discharge of intersections 74, 76 can be supported by an adjustable vertical posts (not shown) so that they can be raised to a desired height. The invention, therefore, in its broadest aspects is not limited to the specific details shown and described. Consequently, departures may be made from the details described herein without departing from the spirit and scope of the invention.

What is claimed is:

1. A soccer training device for returning soccer balls to first and second kicking locations comprising:

first and second screens located first and second distances away from the first and second kicking locations, respectively, the first and second screens adapted to receive and absorb kinetic energy of soccer balls kicked from the first and second kicking locations, respectively;

first and second troughs located adjacent the first and second screens, respectively, each of the troughs located relative to a respective screen to receive soccer balls dropping from its respective screen and convey the soccer balls to a trough discharge;

a conveyor located between the first and the second screens and having a first end located adjacent the trough discharges of the first and second troughs, the conveyor conveying the soccer balls along a single conveying path proximate the first end toward a second end of the conveyor located adjacent the first and the second kicking locations, the conveyor further having first and second discharge paths directed toward the first and second kicking locations, respectively, for discharging at desired velocities first ones of the soccer balls in a first direction toward the first kicking location and second ones of the soccer balls in a second, different direction toward the second kicking location.

2. The soccer training device of claim 1 wherein the conveyor further includes a diverter for directing the first ones of the soccer balls from the single conveying path to the first discharge path and the second ones of the soccer balls from the single conveying path to the second discharge path.

3. The soccer training device of claim 2 wherein the diverter comprises a toggle device responsive to each soccer ball moving along the conveyor the single conveying path for directing alternate ones of the soccer balls to the first and the second discharge paths.

4. The soccer training device of claim 3 wherein the toggle device comprises:

a trigger element rotatably coupled to the conveyor and being moved between first and second positions by successive soccer balls rolling past the trigger element; and a conveyor guide element operatively connected to the trigger element for directing a succession of rolling soccer balls alternatively to the right hand and the left hand sides of the conveyor in response to the trigger element being moved between the first and the second positions, respectively, by the successive soccer balls rolling past the trigger element.

5. The soccer training device of claim 1 wherein the first and second discharge paths are selectively adjustable between a first position immediately adjacent a kicking area surface to cause the soccer balls to generally roll on the kicking area surface upon being discharged from the conveyor, and a second position above the kicking area surface to cause the soccer balls to bounce onto the kicking area surface upon being discharged from the conveyor.

6. The soccer training device of claim 1 wherein the conveyor has a selectively adjustable length to vary a distance between the screens and the kicking locations.

7. The soccer training device of claim 6 wherein the distance between the screens and the kicking locations is variable in a range of from approximately 15 feet to approximately 45 feet.

8. The soccer training device of claim 1 wherein the conveyor further includes first and second curved conveyors providing the respective first and second discharge paths, the first and second curved conveyors providing first and second curved tracks, respectively, for moving the soccer balls through angular paths of approximately 90° and discharging a soccer ball from each of the curved conveyors approximately once every 2 seconds.

9. The soccer training device of claim 1 wherein the conveyor further comprises:

a static conveyor located between the first and the second screens and providing an inclined path for the soccer balls to move from a higher end located adjacent the trough discharge toward a lower end located adjacent and between the first and the second kicking locations; and an elevating conveyor extending in a generally vertical direction and delivering soccer balls from the trough discharge to the higher end of the static conveyor.

10. A soccer training device for returning a soccer ball to a kicking end of a soccer ball kicking area comprising:

a screen located at a first end of the soccer ball kicking area, the screen adapted to receive and absorb kinetic energy of soccer balls kicked from the kicking end of the soccer ball kicking area;

a ball collector located adjacent the screen and extending in a direction toward a collector discharge, and the ball collector receiving the soccer balls dropping from the screen; and a conveyor providing an elevating path for the soccer balls intermediate a first end located adjacent the collector discharge and a second end located adjacent the kicking end of the soccer ball kicking area, the second end of the conveyor being selectively adjustable between a first position immediately adjacent a kicking area surface to cause the soccer balls to generally roll on the kicking area surface upon being discharged from the conveyor, and a second position above the kicking area surface to cause the soccer balls to bounce onto the kicking area surface upon being discharged from the conveyor, whereby the elevating path permits the soccer balls to be discharged toward a kicker at a desired velocity and with selected bouncing and rolling motions to facilitate practicing kicking a moving soccer ball.

11. The soccer training device of claim 10 wherein the conveyor further comprises a controller for varying a speed of the soccer balls along the elevating path.

12. A soccer training device for returning a soccer ball to a kicking location to facilitate practicing soccer ball kicking skills comprising:

a screen located a distance from the kicking location, the screen adapted to receive and absorb kinetic energy of soccer balls kicked from the kicking location;

a ball collector located adjacent the screen and extending in a direction generally parallel to the screen and toward a collector discharge, and the ball collector receiving soccer balls dropping from the screen; and a conveyor providing a sloped path for the soccer balls intermediate a first end located adjacent the collector discharge and a second end located adjacent the kicking location, the second end of the conveyor having a curved conveyor section for moving the soccer balls through an arcuate path and discharging soccer balls from the curved conveyor section at a desired velocity toward the kicking location along a path non-perpendicular to the screen approximately once every two seconds, whereby the arcuate path directs the discharging soccer balls toward a kicker at the desired velocity every two seconds to provide a rapid, repetitive kicking practice.

13. The soccer training device of claim 12 wherein the conveyor further comprises a controller for varying a speed of the soccer balls along the path.

14. A soccer training device for returning a soccer ball to a kicking end of a soccer ball kicking area comprising:

a generally vertical screen located at a first end of the soccer ball kicking area, the screen adapted to receive and absorb kinetic energy of soccer balls kicked from a kicking end of the soccer ball kicking area, the screen having a plurality of target indicia;

a detection device associated with the plurality of target indicia for producing an output signal in response to the soccer balls striking one of the plurality of target indicia;

a ball collector located adjacent to the screen and sloping toward a collector discharge, and a soccer ball conveyor disposed with respect to the collector discharge, the soccer ball conveyor receiving soccer balls from the collector discharge and conveying the soccer balls to the kicking end of the kicking area.

15. The soccer training device of claim 14 wherein the trough is mounted on the kicking area surface and the soccer training device further comprises an inclined ramp surface sloping downward from a forward edge of the ball collector to the kicking end the kicking area surface.

16. The soccer training device of claim 14 wherein the ball collector is a trough and is mounted below the kicking area surface.

17. The soccer training device of claim 14 further comprising a first plurality of target indicia on the screen and a detection device associated with the first plurality of target indicia for producing a plurality of different output signals, each of the different output signals representing a soccer ball striking a different one of the first plurality of target indicia.

18. The soccer training device of claim 14 wherein the detection device comprises:

a second plurality of detectors, each of the detectors associated with at least one of the target indicia and producing a detection signal in response to a soccer ball striking at least one of the target indicia; and a logic controller connected to the second plurality of detectors and producing the plurality of different output signals in response to the detection signal produced from each of the second plurality of detectors.

19. A soccer training device for returning a soccer ball to a kicking end of a soccer ball kicking area comprising:

a screen located at a first end of the soccer ball kicking area, the screen adapted to receive and absorb kinetic energy of soccer balls kicked from a kicking end of the soccer ball kicking area;

a trough located adjacent to the screen and extending in a direction generally parallel to the screen and sloping toward a trough discharge, and the trough having an opening located generally below and forward of the screen to receive the soccer balls dropping from the screen;

a static conveyor providing an inclined path for the soccer balls from a higher end located adjacent the screen to a lower end located at the kicking end of the kicking area; and an elevating conveyor extending upward from the trough discharge to the higher end of the static conveyor, the elevating conveyor having a plurality of soccer ball carriers successively placed along the elevating conveyor for lifting the soccer balls from the trough discharge to the higher end of the static conveyor, each of the ball carriers having a first arcuate member sized to receive a soccer ball and having an opening facing toward a direction of conveyor motion, the first arcuate member fixed to the elevating conveyor and extending outward from the elevating conveyor, and a second arcuate member sized to receive a soccer ball and having an opening facing toward the elevating conveyor, the second arcuate member connected approximately at its midpoint to an outward extending end of the first arcuate member.

20. A soccer training device of claim 19 wherein the first and the second arcuate members comprise respectively first and second generally semicircular members.

21. The soccer training device of claim 19 wherein the first and second arcuate members are made from rod-like material.

22. A soccer training device for use in a soccer ball kicking area comprising:

a generally vertical, yielding and compliant screen located at a first end of the soccer ball kicking area, the screen adapted to receive and stop generally elastic and resilient soccer balls kicked from a kicking end of the soccer ball kicking area;

a first soccer ball conveyor extending in a direction generally parallel to the generally vertical screen, the first soccer ball conveyor being adapted to receive the soccer balls from the screen;

a second soccer ball conveyor providing an inclined path generally between the first end and the kicking end of the kicking area, the second soccer ball conveyor having a higher end located at the first end of the kicking area; and a third soccer ball conveyor extending in a generally vertical direction from the first soccer ball conveyor to the higher end of the second soccer ball conveyor, whereby soccer balls received by the screen drop into the first soccer ball conveyor and are moved to the third conveyor, the third conveyor lifts the soccer balls from the first soccer ball conveyor to the higher end of the second soccer ball conveyor, and the second soccer ball conveyor returns the soccer balls to the kicking end of the kicking area.

23. A soccer training device comprising:

a first pair of target screens located side by side with respect to first and second kicking locations;

a second pair of target screens located side by side with respect to third and fourth kicking locations;

a first conveyor extending in front of the first pair of target screens for receiving soccer balls dropping from the first pair of target screens;

a second conveyor extending in front of the second pair of target screens for receiving soccer balls dropping from the second pair of target screens;

a third conveyor receiving soccer balls from the first and the second conveyors, the third conveyor extending between the first and the second pairs of target screens;

a fourth conveyor receiving soccer balls from the third conveyor, the fourth conveyor having first and second outputs for directing the soccer balls toward the first and the second pairs of target screens, respectively;

a fifth conveyor receiving balls from the first output of the fourth conveyor, the fifth conveyor having first and second outputs for directing the soccer balls to first and second kicking locations within the first pair of kicking locations; and a sixth conveyor receiving balls from the second output of the fourth conveyor, the sixth conveyor having first and second outputs for directing the soccer balls to first and second kicking locations within the second pair of kicking locations.

24. A method for practicing soccer ball kicking skills and returning soccer balls to a kicking end of a soccer ball kicking area comprising:

absorbing with a screen, kinetic energy of soccer balls kicked from a first kicking location at the kicking end of the kicking area;

absorbing with a screen, kinetic energy of soccer balls kicked from a second kicking location at the kicking end of the kicking area;

collecting the soccer balls kicked from the first and second kicking locations and dropping from the screen;

automatically elevating the collected soccer balls;

automatically feeding the soccer balls downward along a return path at a desired velocity toward the first and second kicking locations; and automatically feeding first ones of the soccer balls to the first kicking location and second ones of the soccer balls to the second kicking location, whereby elevating and subsequently feeding the soccer balls downward permits the soccer balls to be fed toward kickers at the first and the second kicking locations at desired velocities.

25. A method for practicing soccer ball kicking skills and returning soccer balls to a kicking end of a soccer ball kicking area comprising:

absorbing with a screen kinetic energy of the soccer balls kicked from the kicking end of the kicking area;

collecting the soccer balls dropping from the screen;

automatically elevating the collected soccer balls;

automatically feeding the soccer balls downward along a return path toward the kicking end of the kicking area at a desired velocity; and presenting the soccer balls with selective rolling and bouncing motions at the kicking end of the kicking area, whereby elevating and subsequently feeding the soccer balls downward permits the soccer balls to be fed toward a kicker at a desired velocity and with the selective bouncing and rolling motions to facilitate practicing kicking a moving soccer ball.

26. The method for practicing soccer ball kicking skills of claim 25 further comprising rolling the soccer balls from an end of the return path across a surface at the kicking end of the kicking area.

27. The method for practicing soccer ball kicking skills of claim 25 further comprising bouncing the soccer balls from an end of the return path on the surface at the kicking end of the kicking area.

28. The method for practicing soccer ball kicking skills of claim 25 further comprising:

detecting the soccer ball striking target indicia on the screen; and providing a sensory perceptible output in response to detecting the soccer ball striking the target indicia.

29. The method for practicing soccer ball kicking skills of claim 28 further comprising:

detecting the soccer ball striking any one of a plurality of target indicia on the screen; and providing a sensory perceptible output associated with the any one of the plurality of target indicia on the screen in response to detecting the soccer ball striking the any one of the target indicia.

30. A soccer training device for returning a soccer ball to a kicking end of a soccer ball kicking area comprising:

a screen located at a first end of the soccer ball kicking area, the screen adapted to receive and absorb kinetic energy of soccer balls kicked from the kicking end of the soccer ball kicking area;

a ball collector located adjacent the screen and extending in a direction toward a collector discharge, and the ball collector receiving the soccer balls dropping from the screen;

a conveyor providing an elevating path and a subsequent sloping path for the soccer balls intermediate a first end located adjacent the collector discharge and a second end located adjacent the kicking end of the soccer ball kicking area;

a motor operatively connected to the conveyor for causing the conveyor to move the soccer balls along the elevating path; and a speed control operatively connected to the motor for selectively varying a speed of the soccer balls moving along the elevating path.

* * * * *